US009052111B2

(12) United States Patent
Erbas-Sen et al.

(10) Patent No.: US 9,052,111 B2
(45) Date of Patent: Jun. 9, 2015

(54) TURBINE ENGINE COMBUSTOR WALL WITH NON-UNIFORM DISTRIBUTION OF EFFUSION APERTURES

(75) Inventors: Nurhak Erbas-Sen, Manchester, CT (US); James B. Hoke, Tolland, CT (US); Albert K. Cheung, East Hampton, CT (US); Robert M. Sonntag, Bolton, CT (US); Timothy S. Snyder, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 77 days.

(21) Appl. No.: 13/531,132

(22) Filed: Jun. 22, 2012

(65) Prior Publication Data

US 2013/0340437 A1 Dec. 26, 2013

(51) Int. Cl.

| | |
|---|---|
| ***F23R 3/00*** | (2006.01) |
| ***F23R 3/06*** | (2006.01) |
| ***F23R 3/04*** | (2006.01) |
| ***F23R 3/10*** | (2006.01) |
| ***F23R 3/50*** | (2006.01) |

(52) U.S. Cl.

CPC ..... *F23R 3/06* (2013.01); *F05B 2260/201* (2013.01); *F23R 3/04* (2013.01); *F05B 2260/202* (2013.01); *F23R 3/002* (2013.01); *F23R 3/10* (2013.01); *F23R 3/50* (2013.01); *F23R 2900/03044* (2013.01)

(58) Field of Classification Search

CPC ..... F02C 3/14; F02C 7/00; F23R 3/42; F23R 3/002; F23R 3/04; F23R 3/06; F05B 2260/201; F05B 2260/202

USPC ..... 60/752–760, 804

See application file for complete search history.

(56) References Cited

U.S. PATENT DOCUMENTS

| | | | | |
|---|---|---|---|---|
| 4,693,667 | A * | 9/1987 | Lenz et al. | 415/115 |
| 4,695,247 | A | 9/1987 | Enzaki et al. | |
| 5,687,572 | A | 11/1997 | Schrantz et al. | |
| 5,758,504 | A | 6/1998 | Abreu et al. | |
| 6,408,629 | B1 | 6/2002 | Harris et al. | |

(Continued)

FOREIGN PATENT DOCUMENTS

EP 1900840 3/2008

OTHER PUBLICATIONS

Syred, "Advanced Combustion and Aerothermal Technologies" 2006, 322, 326-327.*

*Primary Examiner* — Phutthiwat Wongwian
*Assistant Examiner* — William Breazeal
(74) *Attorney, Agent, or Firm* — O'Shea Getz P.C.

(57) ABSTRACT

A turbine engine combustor wall includes support shell and a heat shield. The support shell includes shell quench apertures, first impingement apertures, and second impingement apertures. The combustor heat shield includes shield quench apertures fluidly coupled with the shell quench apertures, first effusion apertures fluidly coupled with the first impingement apertures, and second effusion apertures fluidly coupled with the second impingement apertures. The shield quench apertures and the first effusion apertures are configured in a first axial region of the heat shield, and the second effusion apertures are configured in a second axial region of the heat shield located axially between the first axial region and a downstream end of the heat shield. A density of the first effusion apertures in the first axial region is greater than a density of the second effusion apertures in the second axial region.

14 Claims, 5 Drawing Sheets

(56) References Cited

U.S. PATENT DOCUMENTS

| | | | | |
|---|---|---|---|---|
| 6,546,731 | B2 | 4/2003 | Alkabie et al. | |
| 6,606,861 | B2 | 8/2003 | Snyder | |
| 6,655,149 | B2 | 12/2003 | Farmer et al. | |
| 6,875,529 | B1 | 4/2005 | Spitsberg et al. | |
| 6,955,053 | B1 * | 10/2005 | Chen et al. | 60/804 |
| 6,964,170 | B2 | 11/2005 | Alkabie | |
| 6,982,126 | B2 | 1/2006 | Darolia et al. | |
| 7,093,439 | B2 | 8/2006 | Pacheco-Tougas et al. | |
| 7,093,441 | B2 | 8/2006 | Burd et al. | |
| 7,146,815 | B2 | 12/2006 | Burd | |
| 7,219,498 | B2 | 5/2007 | Hadder | |
| 7,291,403 | B2 | 11/2007 | Nagaraj et al. | |
| 7,326,470 | B2 | 2/2008 | Ulion et al. | |
| 7,464,554 | B2 | 12/2008 | Cheung et al. | |
| 7,614,235 | B2 | 11/2009 | Burd et al. | |
| 7,856,830 | B2 | 12/2010 | Alkabie | |
| 7,910,173 | B2 | 3/2011 | Spitsberg et al. | |
| 8,021,742 | B2 | 9/2011 | Anoshkina et al. | |
| 8,056,342 | B2 | 11/2011 | Shelley et al. | |
| 8,084,086 | B2 | 12/2011 | Hass et al. | |
| 8,099,961 | B2 | 1/2012 | Gerendas | |
| 2007/0271926 | A1 * | 11/2007 | Alkabie | 60/772 |
| 2009/0038935 | A1 | 2/2009 | Floyd et al. | |
| 2009/0084110 | A1 * | 4/2009 | Dudebout et al. | 60/754 |
| 2010/0037620 | A1 | 2/2010 | Chila | |
| 2010/0122537 | A1 * | 5/2010 | Yankowich et al. | 60/754 |
| 2011/0016874 | A1 | 1/2011 | Chandler et al. | |
| 2011/0023495 | A1 | 2/2011 | Bronson et al. | |
| 2011/0126543 | A1 | 6/2011 | Kirsopp et al. | |
| 2011/0151219 | A1 | 6/2011 | Nagaraj et al. | |
| 2011/0185739 | A1 | 8/2011 | Bronson et al. | |
| 2011/0244216 | A1 | 10/2011 | Meyer et al. | |

* cited by examiner

TURBINE ENGINE COMBUSTOR WALL WITH NON-UNIFORM DISTRIBUTION OF EFFUSION APERTURES

BACKGROUND OF THE INVENTION

1. Technical Field

This disclosure relates generally to a turbine engine combustor and, more particularly, to a turbine engine combustor wall with a non-uniform distribution of effusion apertures.

2. Background Information

A turbine engine typically includes a fan, a compressor, a combustor, and a turbine. The combustor typically includes an annular bulkhead extending radially between an upstream end of a radial inner combustor wall and an upstream end of a radial outer combustor wall. The inner and the outer combustor walls can each include an impingement cavity extending radially between a support shell and a heat shield. The support shell can include a plurality of impingement apertures, which directs cooling air from a plenum surrounding the combustor into the impingement cavity and against an impingement cavity surface of the heat shield. The heat shield can include a plurality of effusion apertures, which directs the cooling air from the impingement cavity into the combustion chamber for film cooling a combustion chamber surface of the heat shield.

During operation, fuel provided by a plurality of combustor fuel injectors is mixed with compressed gas within the combustion chamber, and the mixture is ignited. Due to varying flow and combustion temperatures within the combustion chamber, the inner and outer combustor walls can be subject to axially and circumferentially varying combustion chamber gas temperatures. Such varying temperatures can cause significant temperature differentials with combustor walls, which can cause combustor wall material fatigue, etc.

SUMMARY OF THE DISCLOSURE

According to a first aspect of the invention, a combustor wall is provided for a turbine engine with an axial centerline. The combustor wall includes a combustor support shell and a combustor heat shield. The support shell includes a plurality of shell quench apertures, a plurality of first impingement apertures, and a plurality of second impingement apertures. The heat shield includes a plurality of shield quench apertures fluidly coupled with the shell quench apertures, a plurality of first effusion apertures fluidly coupled with the first impingement apertures, and a plurality of second effusion apertures fluidly coupled with the second impingement apertures. The shield quench apertures and the first effusion apertures are configured in a first axial region of the heat shield. The second effusion apertures are configured in a second axial region of the heat shield located axially between the first axial region and a downstream end of the heat shield. A density of the first effusion apertures in the first axial region is greater than a density of the second effusion apertures in the second axial region.

According to a second aspect of the invention, an axial flow combustor is provided for a turbine engine with an axial centerline. The combustor includes a first combustor wall, a second combustor wall with a support shell and a heat shield, and an annular combustor bulkhead extending radially between an upstream end of the first combustor wall and an upstream end of the second combustor wall. The support shell includes a plurality of shell quench apertures, a plurality of first impingement apertures, and a plurality of second impingement apertures. The heat shield includes a plurality of shield quench apertures fluidly coupled with the shell quench apertures, a plurality of first effusion apertures fluidly coupled with the first impingement apertures, and a plurality of second effusion apertures fluidly coupled with the second impingement apertures. The shield quench apertures and the first effusion apertures are configured in a first axial region of the heat shield. The second effusion apertures are configured in a second axial region of the heat shield. The first axial region is located axially between the upstream end of the second combustor wall and the second axial region. A density of the first effusion apertures in the first axial region is greater than a density of the second effusion apertures in the second axial region. The first combustor wall may be disposed radially within the second combustor wall. Alternatively, the second combustor wall may be disposed radially within the first combustor wall.

In some embodiments, the support shell also includes a plurality of third impingement apertures, and the heat shield also includes a plurality of third effusion apertures, which are fluidly coupled with the third impingement apertures. The third effusion apertures are configured in a third axial region of the heat shield located axially between the first axial region and an upstream end of the heat shield. A density of the third effusion apertures in the third axial region is less than the density of the first effusion apertures in the first axial region.

In some embodiments, the density of the third effusion apertures in the third axial region is greater than the density of the second effusion apertures in the second axial region.

In some embodiments, the support shell also includes a plurality of third impingement apertures, and the heat shield also includes a plurality of third effusion apertures, which are fluidly coupled with the third impingement apertures. Axes of more than seventy five percent of the third effusion apertures extend circumferentially through the panel and are substantially perpendicular to the axial centerline. The third effusion apertures are configured in a third axial region of the heat shield located axially between the first axial region and an upstream end of the heat shield. A density of the third effusion apertures in the third axial region may be substantially equal to the density of the first effusion apertures in the first axial region.

In some embodiments, a plurality of the first effusion apertures, located adjacent to a first of the panel quench apertures, have axes that are substantially tangent to a downstream side of the first panel quench aperture.

In some embodiments, the impingement apertures are configured to exhibit a pressure drop across the support shell, and the effusion apertures are configured to exhibit a pressure drop across the heat shield. A ratio of the pressure drop across the support shell to the pressure drop across the heat shield can be between about 2:1 and about 9:1.

In some embodiments, some or all of the impingement apertures and some or all of the effusion apertures have substantially equal diameters. In other embodiments, the diameters of some or all of the effusion apertures are greater than diameters of some or all of the impingement apertures. In still other embodiments, the diameters of some or all of the effusion apertures are less than diameters of some or all of the impingement apertures.

In some embodiments, axes of some or all of the effusion apertures are offset from a combustion chamber surface of the heat shield by between about fifteen and about thirty degrees, and/or axes of some or all of the impingement apertures are substantially perpendicular to an impingement cavity surface of the support shell.

In some embodiments, an impingement cavity extends radially between the support shell and the heat shield, and fluidly couples some or all of the impingement apertures with some or all of the effusion apertures. The support shell has an annular cross-sectional geometry and extends axially between an upstream end and a downstream end. The heat shield has an annular cross-sectional geometry and extends axially between an upstream end and the downstream end of the panel.

In some embodiments, the heat shield is disposed radially within the support shell. In other embodiments, the support shell is disposed radially within the heat shield.

In some embodiments, the heat shield includes a plurality of circumferential heat shield panels and/or a plurality of axial heat shield panels.

In some embodiments, the first axial region and/or the second axial region includes a plurality of circumferential first sub-regions and a plurality of circumferential second sub-regions. A density of the effusion apertures in each first sub-region is greater than a density of the effusion apertures in each second sub-region. The density of the effusion apertures in the respective axial region is equal to an average or mean of the densities of the effusion apertures in the first sub-regions and the densities of the effusion apertures in the second sub-regions.

In some embodiments, the shell quench apertures and the first impingement apertures are configured in a first axial region of the support shell, and the second impingement apertures are configured in a second axial region of the support shell located axially between the first axial region of the support shell and a downstream end of the support shell. A density of the first impingement apertures in the first axial region of the support shell is greater than a density of the second impingement apertures in the second axial region of the support shell.

The foregoing features and the operation of the invention will become more apparent in light of the following description and the accompanying drawings.

DETAILED DESCRIPTION OF THE INVENTION

Figure 1:
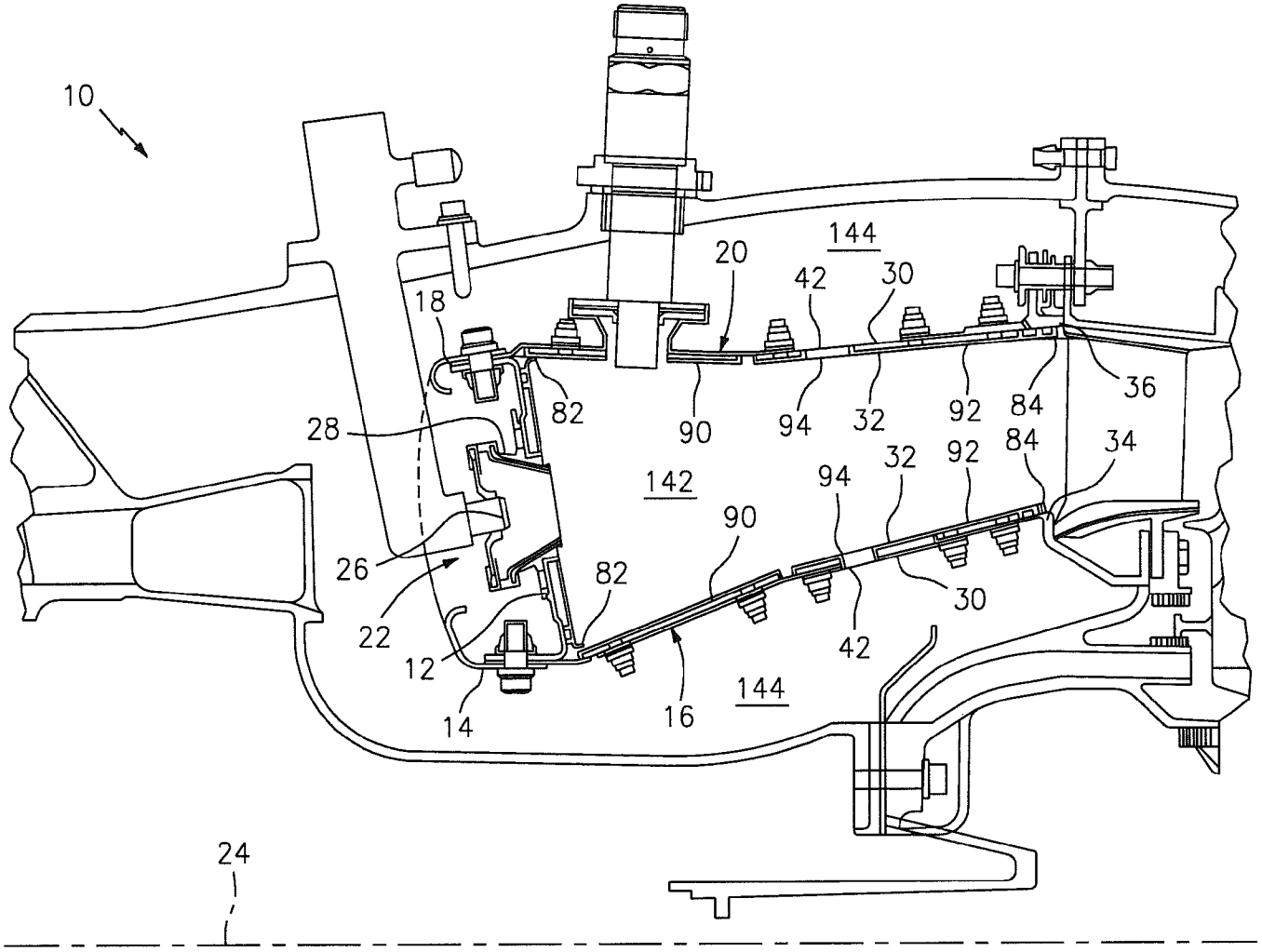
FIG. 1 is a side-sectional diagrammatic illustration of a turbine engine combustor.
Figure 2:
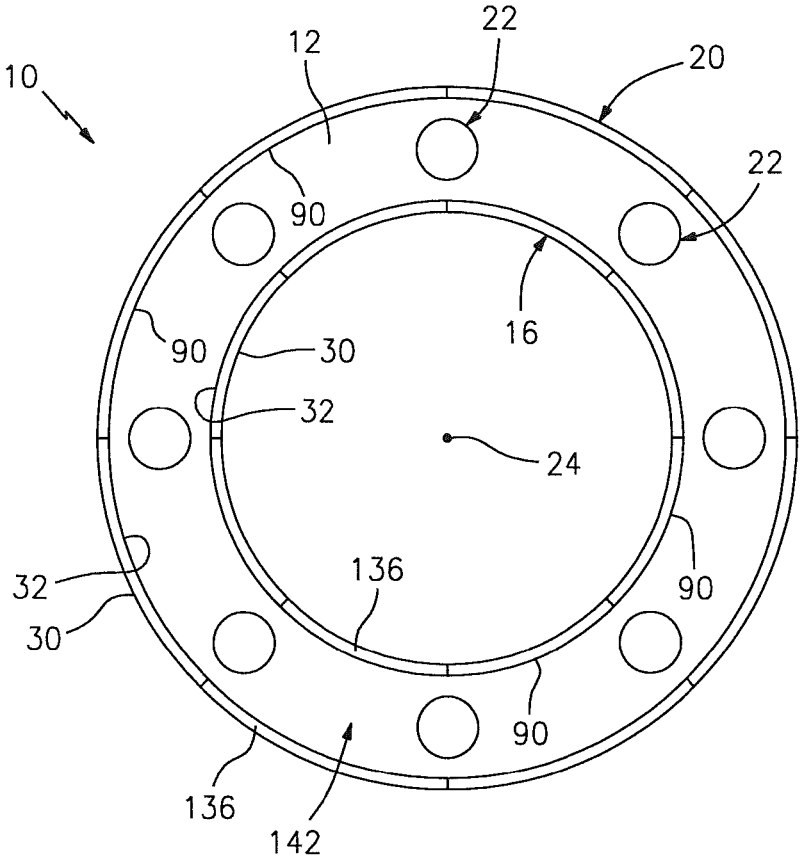
FIG. 2 is a cross-sectional diagrammatic illustration of a turbine engine combustor.

FIGS. 1 and 2 illustrate a combustor 10 (e.g., an axial flow combustor) for a turbine engine. The combustor 10 includes an annular combustor bulkhead 12 that extends radially between an upstream end 14 of a first (e.g., radial inner) combustor wall 16 and an upstream end 18 of a second (e.g., radial outer) combustor wall 20. The combustor 10 also includes a plurality of fuel injector assemblies 22 connected to the bulkhead 12, and arranged circumferentially around an axial centerline 24 of the engine. Each of the fuel injector assemblies 22 includes a fuel injector 26, which can be mated with a swirler 28.

Figure 3:
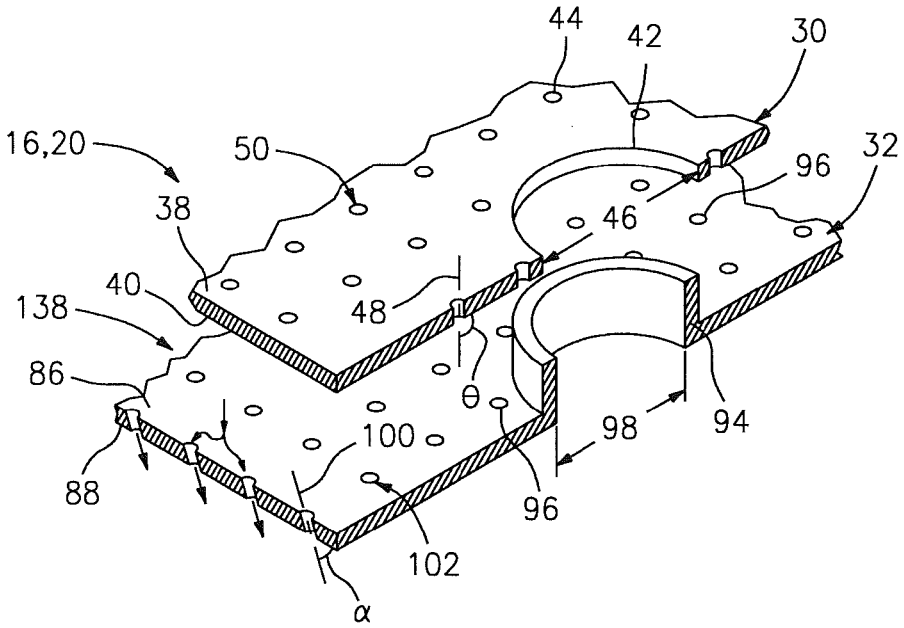
FIG. 3 is an exploded, perspective diagrammatic illustration of a section of a combustor wall.

The first combustor wall 16 and the second combustor wall 20 can each include a combustor support shell 30 and a combustor heat shield 32. The support shell 30 extends axially between the upstream end 14, 18 and a downstream end 34, 36. The support shell 30 extends circumferentially around the axial centerline 24, which provides the support shell 30 with an annular cross-sectional geometry. Referring to FIG. 3, the support shell 30 also extends radially between a combustor plenum surface 38 and a first impingement cavity surface 40. Referring again to FIGS. 1 and 2, the support shell 30 can be constructed as a single integral tubular body. Alternatively, the support shell 30 can be assembled from a plurality of circumferential support shell panels and/or a plurality of axial support shell panels.

Referring to FIG. 3, the support shell 30 includes a plurality of shell quench apertures 42 and a plurality of impingement apertures (e.g., the apertures 44). The shell quench apertures 42 extend radially through the support shell 30 between the combustor plenum surface 38 and the first impingement cavity surface 40. Each of the shell quench apertures 42 can have a circular cross-sectional geometry with a first diameter 46.

Figure 4:
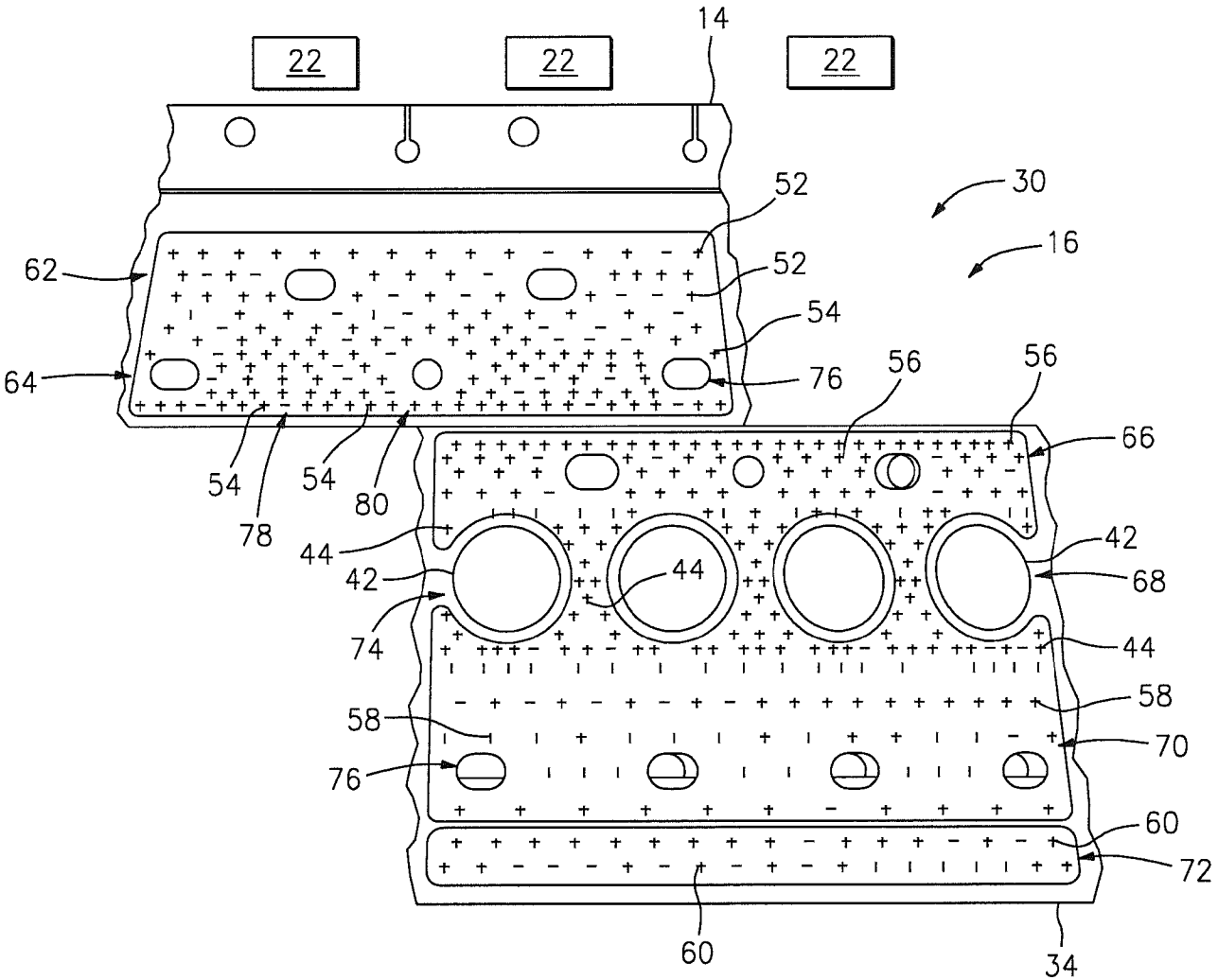
FIG. 4 is a diagrammatic illustration of a section of a combustor support shell.

The impingement apertures (e.g., the apertures 44) extend radially through the support shell 30 between the combustor plenum surface 38 and the first impingement cavity surface 40. Each of the impingement apertures (e.g., the apertures 44) has an axis 48 that is angularly offset from first impingement cavity surface 40, for example, by an angle θ of about ninety degrees. Each of the impingement apertures (e.g., the apertures 44) can have a circular cross-sectional geometry with a second diameter 50, which is substantially (e.g., at least five to twenty times) smaller than the first diameter 46. Referring to FIG. 4, the impingement apertures can include a plurality of first impingement apertures 52, a plurality of second impingement apertures 54, a plurality of third impingement apertures 56, a plurality of fourth impingement apertures 44, a plurality of fifth impingement apertures 58, and a plurality of sixth impingement apertures 60.

The shell quench apertures 42 and the impingement apertures can be arranged in one or more support shell cooling regions. The first impingement apertures 52, for example, are arranged in a first axial region 62. The first axial region 62 extends axially from a second axial region 64 towards the upstream end 14, 18, and circumferentially around the centerline 24. The second impingement apertures 54 are arranged in the second axial region 64. The second axial region 64 extends axially from the first axial region 62 to a third axial region 66, and circumferentially around the centerline 24. The third impingement apertures 56 are arranged in the third axial region 66. The third axial region 66 extends axially from the second axial region 64 to a fourth axial region 68, and circumferentially around the centerline 24. The shell quench apertures 42 and the fourth impingement apertures 44 are arranged in the fourth axial region 68. The fourth axial region 68 extends axially from the third axial region 65 to a fifth axial region 70, and circumferentially around the centerline 24. The fifth impingement apertures 58 are arranged in the fifth axial region 70. The fifth axial region 70 extends axially from the fourth axial region 68 to a sixth axial region 72, and circumferentially around the centerline 24. The sixth impingement apertures 60 are arranged in the sixth axial region 72. The sixth axial region 72 extends axially from the fifth axial region 70 towards (e.g., to) the downstream end 34, 36, and circumferentially around the centerline 24.

The number of and relative spacing between the impingement apertures included in each of the support shell cooling regions is selected to provide each cooling region with a respective impingement aperture density. The term "impingement aperture density" describes a ratio of the number of impingement apertures included in a unit (e.g., a square inch)

of substantially unobstructed support shell surface area. Unobstructed support shell surface area can include, for example, portions of the first impingement cavity surface 40 that do not include non-cooling apertures (e.g., the shell quench apertures 42) and/or other support shell features such as, for example, bosses, studs, flanges, rails, etc. connected to the combustor plenum surface 38. Obstructed support shell surfaces can include, for example, first regions 74 of the first impingement cavity surface opposite shell quench aperture 42 rails, and second regions 76 of the first impingement cavity surface opposite stud apertures.

In the specific embodiment of FIG. 4, the support shell 30 includes $N_1$ number of the first impingement apertures 52, which provides the first axial region 62 with a first impingement aperture density. The support shell 30 includes $N_2$ number of the second impingement apertures 54, which provides the second axial region 64 with a second impingement aperture density that is, for example, greater than the first impingement aperture density. The support shell 30 includes $N_3$ number of the third impingement apertures 56, which provides the third axial region 66 with a third impingement aperture density that is, for example, greater than (or substantially equal) to the second impingement aperture density. The support shell 30 includes $N_4$ number of the fourth impingement apertures 44, which provides the fourth axial region 68 with a fourth impingement aperture density that is, for example, substantially equal to the third impingement aperture density. The support shell 30 includes $N_5$ number of the fifth impingement apertures 58, which provides the fifth axial region 70 with a fifth impingement aperture density. The fifth impingement aperture density is, for example, less than the second, third and fourth impingement aperture densities, and substantially equal to the first impingement aperture density. The support shell 30 includes $N_6$ number of the sixth impingement apertures 60, which provides the sixth axial region 72 with a sixth impingement aperture density. The sixth impingement aperture density is, for example, greater than the fifth impingement aperture density, and substantially equal to or less than the fourth impingement aperture density.

In some embodiments, the impingement aperture density in one or more of the support shell cooling regions may change (e.g., intermittently increase and decrease) as the region extends circumferentially around the centerline 24. In the specific embodiment of FIG. 4, for example, the second axial region 64 includes a plurality of (e.g., triangular, trapezoidal, etc.) circumferential first sub-regions 78 and a plurality of (e.g., triangular, trapezoidal, etc.) circumferential second sub-regions 80. The first sub-regions 78 are configured to be circumferentially aligned with the fuel injector assemblies 22. Each of the second sub-regions 80 extends circumferentially between two respective first sub-regions 78. The density of the second impingement apertures 54 in the first sub-regions 78 is greater than that of the second sub-regions 80. In such an embodiment, the impingement aperture density of the second axial region 64 can be calculated as the average or mean of the densities of the first and second sub-regions 78 and 80.

Referring again to FIGS. 1 and 2, the heat shield 32 extends axially between an upstream end 82 and a downstream end 84. The heat shield 32 extends circumferentially around the axial centerline 24, which provides the heat shield 32 with an annular cross-sectional geometry. Referring to FIG. 3, the heat shield 32 also extends radially between a second impingement cavity surface 86 and a combustion chamber surface 88. Referring again to FIGS. 1 and 2, the heat shield 32 can be assembled from a plurality of circumferential heat shield panels 90 and 92 and/or a plurality of axial heat shield panels 90 and 92. Alternatively, the heat shield 32 can be constructed as a single integral tubular body.

Referring to FIG. 3, the heat shield 32 includes a plurality of shield quench apertures 94 and a plurality of effusion apertures (e.g., the apertures 96). The shield quench apertures 94 extend radially through the heat shield 32 between the second impingement cavity surface 86 and the combustion chamber surface 88. Each of the shield quench apertures 94 can have a circular cross-sectional geometry with a third diameter 98. The third diameter 98 may be less than the first diameter 46 where, for example, the heat shield 32 includes annular flanges that nest within the shell quench apertures 42 and fluidly couple the shield quench apertures 94 to the shell quench apertures 42. Alternatively, the third diameter 98 may be greater than or equal to the first diameter 46.

Figure 5:
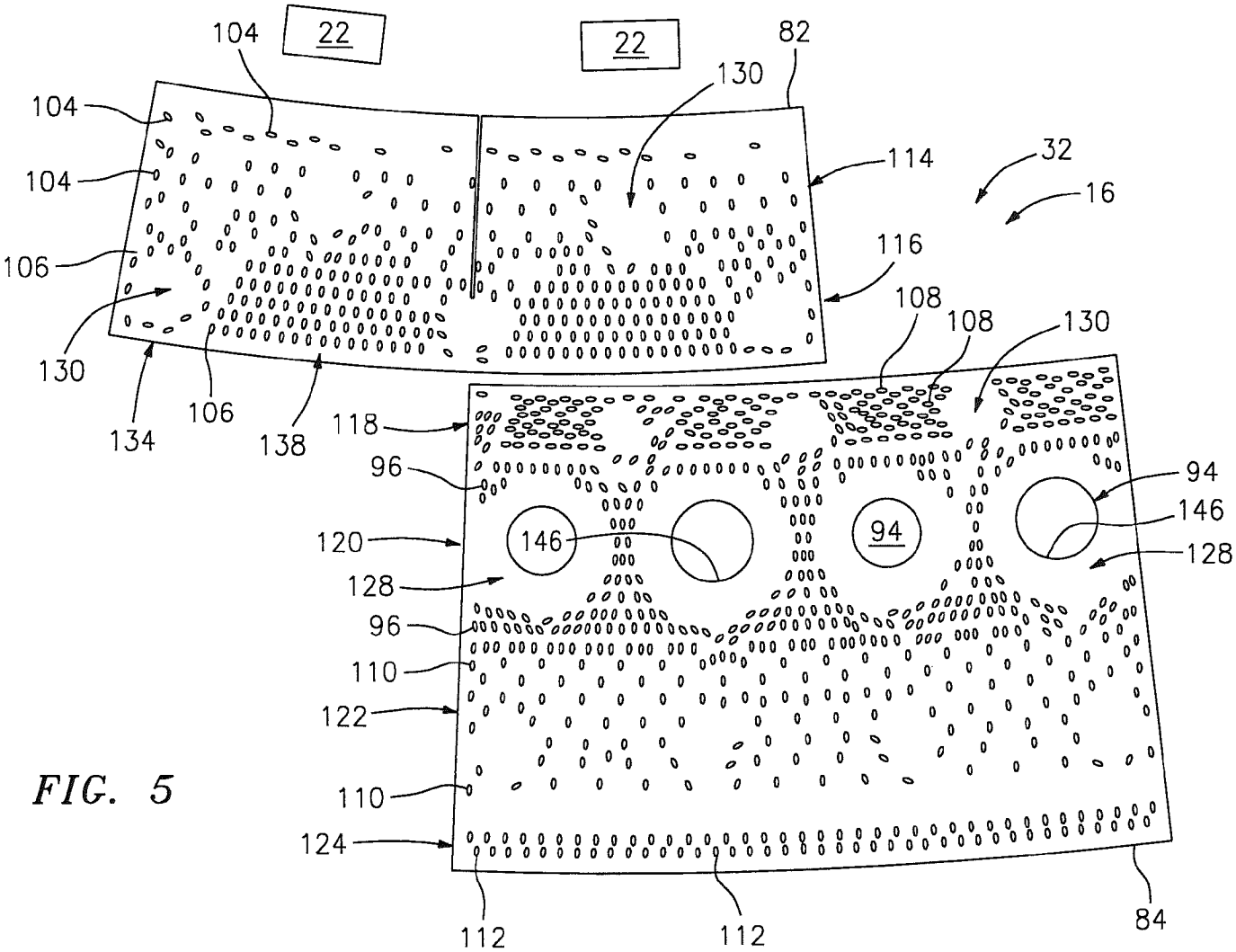
FIG. 5 is a diagrammatic illustration of a section of a combustor heat shield.

The effusion apertures (e.g., the apertures 96) extend radially through the heat shield 32 between the second impingement cavity surface 86 and the combustion chamber surface 88. Each of the effusion apertures (e.g., the apertures 96) has an axis 100 that is angularly offset from the combustion chamber surface 88, for example, by an angle $\alpha$ of between about fifteen and about thirty degrees (e.g., about 25°). Each of the effusion apertures (e.g., the apertures 96) can have a circular cross-sectional geometry with a fourth diameter 102, which is substantially (e.g., at least five to twenty times) smaller than the third diameter 98. The fourth diameter 102 of some or all of the effusion apertures can be greater than, less than or equal to the second diameter 50. Referring to FIG. 5, the effusion apertures can include a plurality of first effusion apertures 104, a plurality of second effusion apertures 106, a plurality of third effusion apertures 108, a plurality of fourth effusion apertures 96, a plurality of fifth effusion apertures 110, and a plurality of sixth effusion apertures 112.

The shield quench apertures 94 and the effusion apertures can be arranged in one or more heat shield cooling regions. The first effusion apertures 104, for example, are arranged in a first axial region 114. The first axial region 114 extends axially from a second axial region 116 towards (e.g., to) the upstream end 82, and circumferentially around the centerline 24. The second effusion apertures 106 are arranged in the second axial region 116. The second axial region 116 extends axially from the first axial region 114 to a third axial region 118, and circumferentially around the centerline 24. The third effusion apertures 108 are arranged in the third axial region 118. The third axial region 118 extends axially from the second axial region 116 to a fourth axial region 120, and circumferentially around the centerline 24. The shield quench apertures 94 and the fourth effusion apertures 96 are arranged in the fourth axial region 120. The fourth axial region 120 extends axially from the third axial region 118 to a fifth axial region 122, and circumferentially around the centerline 24. The fifth effusion apertures 110 are arranged in the fifth axial region 122. The fifth axial region 122 extends axially from the fourth axial region 120 to a sixth axial region 124, and circumferentially around the centerline 24. The sixth effusion apertures 112 are arranged in the sixth axial region 124. The sixth axial region 124 extends axially from the fifth axial region 122 towards (e.g., to) the downstream end 84, and circumferentially around the centerline 24.

The number of and relative spacing between the effusion apertures included in each of the heat shield cooling regions is selected to provide each cooling region with a respective effusion aperture density. The term "effusion aperture density" describes a ratio of the number of effusion apertures included in a unit (e.g., a square inch) of substantially unobstructed heat shield surface area. Unobstructed heat shield surface area can include, for example, portions of the combustion chamber surface 88 that do not include non-cooling apertures (e.g., the shield quench apertures 94) and/or other heat shield features such as, for example, bosses, studs, flanges, rails, etc. connected to the second impingement cavity surface 86. Obstructed heat shield surfaces can include, for example, first regions 128 of the combustion chamber surface opposite shell quench aperture 94 rails, and second regions 130 of the combustion chamber surface opposite studs.

In the specific embodiment of FIG. 5, the heat shield 32 includes $M_1$ number of the first effusion apertures 104, which provides the first axial region 114 with a first effusion aperture density. The heat shield 32 includes $M_2$ number of the second effusion apertures 106, which provides the second axial region 116 with a second effusion aperture density that is, for example, greater than the first effusion aperture density. The heat shield 32 includes $M_3$ number of the third effusion apertures 108, which provides the third axial region 118 with a third effusion aperture density that is, for example, greater than (or substantially equal) to the second effusion aperture density. The heat shield 32 includes $M_4$ number of the fourth effusion apertures 96, which provides the fourth axial region 120 with a fourth effusion aperture density that is, for example, substantially equal to the third effusion aperture density. The heat shield 32 includes $M_5$ number of the fifth effusion apertures 110, which provides the fifth axial region 122 with a fifth effusion aperture density. The fifth effusion aperture density is, for example, less than the second, third and fourth effusion aperture densities, and substantially equal to the first effusion aperture density. The heat shield 32 includes $M_6$ number of the sixth effusion apertures 112, which provides the sixth axial region 124 with a sixth effusion aperture density. The sixth effusion aperture density is, for example, greater than the fifth effusion aperture density, and substantially equal to or less than the fourth effusion aperture density.

In some embodiments, the effusion aperture density in one or more of the heat shield cooling regions may change (e.g., intermittently increase and decrease) as the region extends circumferentially around the centerline 24. In the specific embodiment of FIG. 5, for example, the second axial region 116 includes a plurality of (e.g., triangular, trapezoidal, etc.) circumferential first sub-regions 132 and a plurality of (e.g., triangular, trapezoidal, etc.) circumferential second sub-regions 134. The first sub-regions 132 are configured to be circumferentially aligned with the fuel injector assemblies 22. Each of the second sub-regions 134 extends circumferentially between two respective first sub-regions 132. The density of the second effusion apertures 106 in the first sub-regions 132 is greater than that of the second sub-regions 134. In such an embodiment, the effusion aperture density of the second axial region 116 can be calculated as the average or mean of the densities of the first and second sub-regions 132 and 134.

Referring to FIG. 1, the support shell 30 of the first combustor wall 16 is located radially within the heat shield 32 of the first combustor wall 16. The heat shield 32 of the second combustor wall 20 is located radially within the support shell 30 of the second combustor wall 20. The heat shields 32 are respectively connected to the support shells 30 with a plurality of fasteners (e.g., heat shield studs and nuts). Each of the shell quench apertures 42 is fluidly coupled to a respective one of the shield quench apertures 94.

Figure 6:
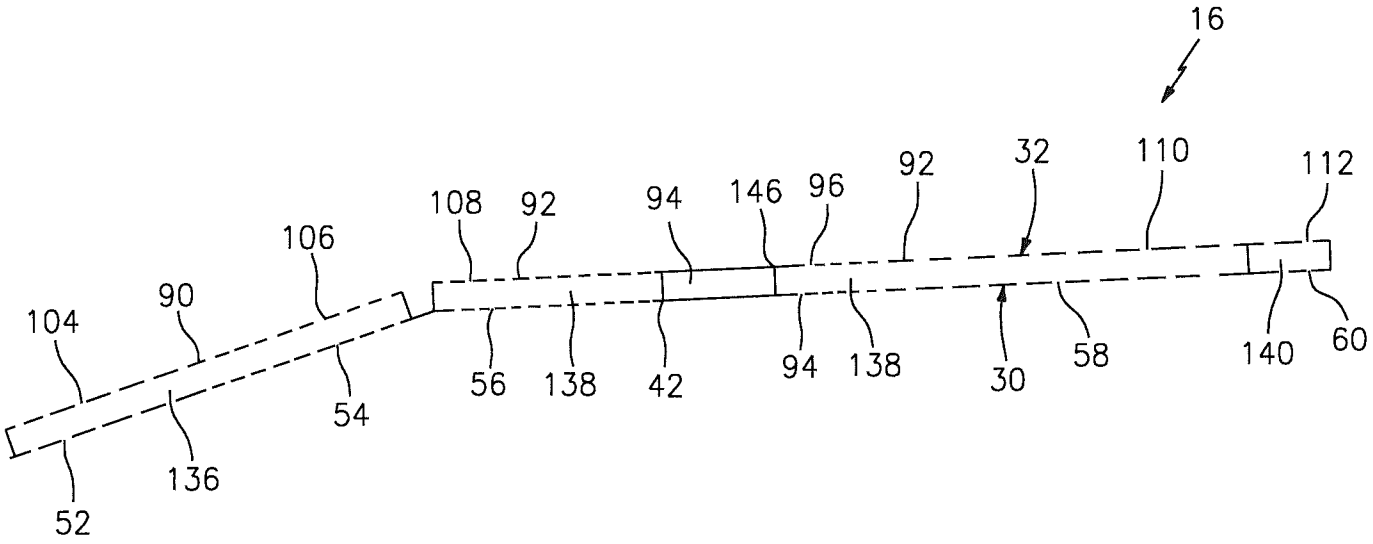
FIG. 6 is a side-sectional diagrammatic illustration of a combustor wall.

Referring to FIG. 6, one or more axial and/or circumferential impingement cavities are respectively defined between the support shell 30 and the heat shield 32. In the specific embodiment of FIG. 6, for example, a first axial impingement cavity 136 extends between the support shell 30 and the panel 90 of the heat shield 32. Second and third axial impingement cavities 138 and 140 extend between the support shell 30 and the panel 92 of the heat shield 32. The first axial impingement cavity 136 respectively fluidly couples the first and second impingement apertures 52 and 54 with the first and second effusion apertures 104 and 106. The second impingement cavity 138 respectively fluidly couples the third, fourth and fifth impingement apertures 56, 44 and 58 with the third, fourth and fifth effusion apertures 108, 96 and 110. The third impingement cavity 140 fluidly couples the sixth impingement apertures 60 with the sixth effusion apertures 112.

During operation of the combustor 10 of FIG. 1, fuel provided by the fuel injectors 26 is mixed with compressed gas within the combustion chamber 142, and the mixture is ignited. Due to varying flow and combustion temperatures within the combustion chamber 142, the first and/or second combustor walls 16 and 20 can be subject to axially and/or circumferentially varying combustion chamber 142 gas temperatures. Such varying temperatures can cause significant temperature differentials within walls of prior art combustors as described above. The configuration of the impingement and effusion apertures shown in FIGS. 4 to 6, however, can significantly reduce and/or eliminate temperature differentials within the first and second combustor walls 16 and 20. The densities of the impingement and effusion apertures, for example, are relatively high adjacent regions of the combustion chamber 142 that have relatively high combustion chamber 142 gas temperatures. The densities of the impingement and effusion apertures are relatively low adjacent regions of the combustion chamber 142 that have relatively low combustion chamber 142 gas temperatures. In this manner, the first and second combustor walls 16 and 20 can receive additional cooling air from the combustor plenum 144 in relatively hot regions of the combustion chamber 142 and less cooling air in relatively cool regions of the combustion chamber 142. Thus, the densities of the impingement and effusion apertures can be tailored such that the first and second combustor walls 16 and 20 are substantially isothermal during one or more modes of combustor 10 operation, which can reduce combustor wall material fatigue, etc.

Cooling air flowing through the impingement apertures in the support shell 30 is subject to a cooling air first pressure drop between the combustor plenum surface 38 and the first impingement cavity surface 40. The magnitude of the first pressure drop is influenced by the number and/or diameter of the impingement apertures. Cooling air flowing through the effusion apertures in the heat shield 32 is subject to a cooling air second pressure drop between the second impingement cavity surface 86 and the combustion chamber surface 88. The magnitude of the second pressure drop is influenced by the number and/or diameter of the effusion apertures. In some embodiments, the numbers and/or diameters of the impingement and effusion apertures are selected such that a ratio of the first pressure drop to the second pressure drop is between about two to one (2:1) and about nine to one (9:1).

Referring to FIGS. 3 and 5, some or all of the axes 100 of the effusion apertures within a respective axial region of the heat shield 32 may be uniformly or non-uniformly aligned depending on, for example, (i) the flow and combustion temperatures of an adjacent region of the combustion chamber 142 and/or (ii) additional features (e.g., quench aperture, stud, etc.) included in the region. For example, more than about seventy five percent (e.g., between about 80-100%) of the axes 100 of the third effusion apertures 108 in the third axial region 118 are aligned substantially perpendicular to the centerline 24 such that the cooling air flows into the combustion chamber 142 in a similar direction to the swirling combustion chamber 142 gas. In another example, the axes 100 of the fourth effusion apertures 96 in the fourth axial region 120 are arranged in various directions to cool the obstructed regions 128 surrounding the shield quench apertures 94. The axes 100 of the fourth effusion apertures 96, which are located downstream and adjacent to a respective one of the shield quench apertures 94 for example, are substantially tangent to a downstream side 146 of the shield quench aperture 94. In this manner, these fourth effusion apertures 96 can disturb stagnant flow regions within the combustion chamber 142; e.g., wake regions downstream of the shield quench apertures 94. In still another example, the axes 100 of some of the first effusion apertures 104 are aligned substantially perpendicular to the centerline 24, while axes 100 of others of the first effusion apertures 104 are aligned substantially parallel to the centerline 24. Alternative examples of suitable effusion (and impingement) aperture arrangements and alignments are disclosed in U.S. Pat. No. 7,093,439, which is hereby incorporated by reference in its entirety.

In some embodiments, for example as illustrated in FIG. 3, the impingement apertures 44 are offset from the effusion apertures 96. In this manner, the cooling air can impinge against and, thus, cool the second impingement cavity surface 86 before flowing into the effusion apertures 96.

In some embodiments, the effusion aperture density of one or more of the axial regions is between about one hundred and about three hundred effusion apertures per unit of combustion chamber surface 88. In general, the effusion aperture density is relatively large where the angular offset between the effusion apertures and the combustion chamber surface 88 is relatively large (e.g., about thirty degrees). The effusion aperture density is relatively small where the angular offset between the effusion apertures and the combustion chamber surface 88 is relatively small (e.g., about fifteen degrees).

In some embodiments, one or more of the heat shields 32 includes a thermal barrier coating (TBC) applied to the combustion chamber surface 88. The thermal barrier coating can include ceramic and/or any other suitable non-ceramic thermal barrier material.

In some embodiments, bosses surrounding the quench apertures (42 or 94) may be interconnected and fluidly separate the cavity 138 into, for example, an axial forward cavity and an axial aft cavity.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A combustor wall for a turbine engine with an axial centerline, comprising:

a combustor support shell including a plurality of shell quench apertures, a plurality of first impingement apertures, and a plurality of second impingement apertures; and a combustor heat shield including a plurality of shield quench apertures fluidly coupled with the shell quench apertures, a plurality of first effusion apertures fluidly coupled with the first impingement apertures, and a plurality of second effusion apertures fluidly coupled with the second impingement apertures;

wherein the shield quench apertures and the first effusion apertures are configured in a first axial region of the heat shield, and the second effusion apertures are configured in a second axial region of the heat shield located axially between the first axial region and a downstream end of the heat shield;

wherein a density of the first effusion apertures in the first axial region is greater than a density of the second effusion apertures in the second axial region;

wherein at least one of the first axial region or the second axial region includes a plurality of circumferential first sub-regions and a plurality of circumferential second sub-regions;

wherein a density of the effusion apertures in each first sub-region is greater than a density of the effusion apertures in each second sub-region; and wherein the density of the effusion apertures in the respective axial region is equal to an average or mean of the densities of the effusion apertures in the first sub-regions and the densities of the effusion apertures in the second sub-regions.

2. The combustor wall of claim 1, wherein the combustor wall is included in an axial flow combustor that further includes a second combustor wall and an annular combustor bulkhead extending radially between an upstream end of the combustor wall and an upstream end of the second combustor wall.

3. The combustor wall of claim 2, wherein the combustor wall is disposed radially within the second combustor wall.

4. The combustor wall of claim 2, wherein the second combustor wall is disposed radially within the combustor wall.

5. The combustor wall of claim 2, wherein the support shell further includes a plurality of third impingement apertures;

the heat shield further includes a plurality of third effusion apertures fluidly coupled with the third impingement apertures;

the third effusion apertures are configured in a third axial region of the heat shield located axially between the first axial region and an upstream end of the heat shield; and a density of the third effusion apertures in the third axial region is less than the density of the first effusion apertures in the first axial region.

6. The combustor wall of claim 2, wherein the support shell further includes a plurality of third impingement apertures;

the heat shield further includes a plurality of third effusion apertures fluidly coupled with the third impingement apertures;

axes of more than seventy five percent of the third effusion apertures extend circumferentially through the heat shield and are substantially perpendicular to the axial centerline; and the third effusion apertures are configured in a third axial region of the heat shield located axially between the first axial region and anthe upstream end of the heat shield.

7. The combustor wall of claim 1, wherein each of the first sub-regions is configured for circumferential alignment with a respective fuel injector assembly of the combustor.

8. The combustor wall of claim 1, wherein the heat shield is disposed radially within the support shell.

9. The combustor wall of claim 1, wherein the heat shield includes at least one of a plurality of circumferential heat shield panels and a plurality of axial heat shield panels.

10. The combustor wall of claim 1, wherein a plurality of the impingement apertures and a plurality of the effusion apertures have substantially equal diameters.

11. The combustor wall of claim 1, wherein diameters of a plurality of the effusion apertures are greater than diameters of a plurality of the impingement apertures.

12. The combustor wall of claim 1, wherein axes of a plurality of the effusion apertures are offset from a combustion chamber surface of the heat shield by between about fifteen and about thirty degrees; and axes of a plurality of the impingement apertures are substantially perpendicular to an impingement cavity surface of the support shell.

13. The combustor wall of claim 1, wherein an impingement cavity extends radially between the support shell and the heat shield, and fluidly couples at least some of the impingement apertures with at least some of the effusion apertures;

the support shell has an annular cross-sectional geometry and extends axially between an upstream end of the support shell and a downstream end of the support shell; and the heat shield has an annular cross-sectional geometry and extends axially between an upstream end of the heat shield and the downstream end of the heat shield.

14. The combustor wall of claim 1, wherein a plurality of the first effusion apertures located adjacent to a first of the panel quench apertures have axes that are substantially tangent to a downstream side of the first panel quench aperture.

* * * * *